US011050193B2

(12) United States Patent
Brennauer et al.

(10) Patent No.: US 11,050,193 B2
(45) Date of Patent: Jun. 29, 2021

(54) ANGLED PLUG CONNECTOR WITH SHIELDING

(71) Applicants: ept Holding GmbH & Co. KG, Peiting (DE); Phoenix Contact GmbH & Co. KG, Blomberg (DE)

(72) Inventors: Georg Brennauer, Wildsteig (DE); Nico Wassel, Blomberg (DE); Arndt Schafmeister, Dörentrup (DE)

(73) Assignees: EPT HOLDING GMBH & CO. KG, Peiting (DE); PHOENIX CONTACT GMBH & CO. KG :, Blomberg (DE)

( * ) Notice: Subject to any disclaimer, the term of this patent is extended or adjusted under 35 U.S.C. 154(b) by 0 days.

(21) Appl. No.: 16/599,165

(22) Filed: Oct. 11, 2019

(65) Prior Publication Data

US 2020/0119494 A1 Apr. 16, 2020

(30) Foreign Application Priority Data

Oct. 12, 2018 (DE) ..... 10 2018 125 337.0

(51) Int. Cl.

| | |
|---|---|
| ***H01R 13/648*** | (2006.01) |
| ***H01R 13/28*** | (2006.01) |
| ***H01R 24/00*** | (2011.01) |
| ***H01R 13/6582*** | (2011.01) |
| ***H01R 43/16*** | (2006.01) |
| ***H01R 43/20*** | (2006.01) |
| *H01R 13/6594* | (2011.01) |

(52) U.S. Cl.

CPC ..... *H01R 13/6582* (2013.01); *H01R 43/16* (2013.01); *H01R 43/20* (2013.01); *H01R 13/6594* (2013.01)

(58) Field of Classification Search

CPC ..... H01R 13/658; H01R 23/6873; H01R 23/688; H01R 33/7628; H01R 13/6582

USPC ..... 439/607.34, 607.4

See application file for complete search history.

(56) References Cited

U.S. PATENT DOCUMENTS

| | | | | |
|---|---|---|---|---|
| 5,564,949 | A * | 10/1996 | Wellinsky | H01R 13/703 439/607.37 |
| 6,086,420 | A | 7/2000 | Wu | |
| 6,120,321 | A * | 9/2000 | Wu | H01R 12/725 439/541.5 |
| 6,604,964 | B2 * | 8/2003 | Hoshino | H01R 13/518 439/607.55 |
| 7,384,310 | B2 * | 6/2008 | Hu | H01R 24/64 439/607.01 |
| 2008/0188135 | A1 * | 8/2008 | Yuan | H01R 12/725 439/638 |
| 2009/0042448 | A1 * | 2/2009 | He | H01R 12/712 439/650 |

(Continued)

FOREIGN PATENT DOCUMENTS

JP 2008-192474 A 8/2008

*Primary Examiner* — Abdullah A Riyami
*Assistant Examiner* — Thang H Nguyen
(74) *Attorney, Agent, or Firm* — Nixon & Vanderhye

(57) ABSTRACT

An angled plug connector has an insulating housing made of plastic and a two-part shielding, consisting of a first (upper) shielding sheet and a second (lower) shielding, the shielding sheet being formed in one piece or in one part. The shieldings are at least partially arranged in the interior of the insulating housing. The shieldings can be easily stamped from a metal sheet, cut, then bent and inserted into the insulating housing.

12 Claims, 5 Drawing Sheets

(56) References Cited

U.S. PATENT DOCUMENTS

| | | | | |
|---|---|---|---|---|
| 2009/0098767 | A1* | 4/2009 | Long | H01R 13/658<br>439/541.5 |
| 2015/0111433 | A1* | 4/2015 | Hou | H01R 13/514<br>439/626 |
| 2020/0144772 | A1* | 5/2020 | Trout | H01R 13/658 |

* cited by examiner

ANGLED PLUG CONNECTOR WITH SHIELDING

TECHNICAL AREA

The invention relates to an angled plug connector comprising an insulating housing, angled contact elements for establishing a connection between a corresponding plug and a printed circuit board, and a first shielding and a second shielding which form a shielded channel. In addition, the invention relates to a method for producing such an angled plug connector.

STATE OF THE ART

Angled plug connectors for connection to a mating plug and to a printed circuit board are known in different designs. There may be an insulating body for insertion into a bushing insulating housing, or an insulating housing for receiving a mating plug.

In order to shield electromagnetic interference from the signal contacts and discharge the interference currents or return currents, shieldings, that is, shield plates, are used, which are connected to both the mating plug and the printed circuit board. Most of the shield plates are arranged on the outside of an insulating body or housing. Overall, however, the production and attachment of the shield plates on or in the insulating housing increase the complexity of the production and assembly process.

OBJECT OF THE INVENTION

Accordingly, the object of the present invention is to provide an angled plug connector with electrical shielding and a production method therefor which is simple and effective in manufacturing and assembling the shielding or the plug connector.

TECHNICAL SOLUTION

This object is achieved by the provision of a plug connector and a production method for the plug connector as recited by the claims and described herein. Advantageous embodiments are specified in the dependent claims.

An angled plug connector according to the invention comprises an insulating housing, angled contact elements for establishing a connection between a corresponding plug and a printed circuit board, and a first shielding and a second shielding which form a shielded channel. The first shielding is formed as an angled metal sheet and in one part or in one piece and inserted from the side facing away from the plug side into the plug-in region of the plug face of the insulating housing. When the insulating housing is designed like a bushing, the interior of the socket forms the plug face. In particular, sections of the shieldings can be inserted into corresponding apertures and/or receptacles of the housing during assembly.

In this application the term "sheet" is used, e.g. "metal sheet", "angled sheet", "shielding sheet" etc. In this application the term "sheet" includes the term "plate", e.g. "shielding sheet" includes "shield plate" or "shielding plate". The term "sheet" is meant to be a thin plate which may be stamped to form cutouts, gaps etc., and portions of the sheet may be bent to form an angle.

The two shieldings may comprise or consist of, for example, two or more shielding sheets that shield electromagnetic interference fields from the signal contacts and discharge the interference currents and return currents. For this reason, the shielding sheets contact both the mating plug and a connection to the printed circuit board. The shielding sheets lie in the plug-in region, among other things, within the plug face of the insulating housing. A contact with the mating plug is thus possible and the shielding sheets are protected against external influences. The handling of the plug connector in the assembly and packaging process is facilitated since a flat, planar outer surface can be provided on the outer side of the insulating housing, the surface enabling suction by a handling machine during the processing process.

The insulating housing is fitted from the side facing away from the plug side (of the mating plug). The shielding sheet can already be completely bent when being placed for connection to the printed circuit board, thereby simplifying the assembly. Shielding sheets are placed by introducing, sliding in, inserting and/or guiding in the shielding or shieldings into the interior of the insulating housing.

The first shielding and/or the second shielding are arranged in particular in the plug-in region of the plug face such that a mating plug provided with external contacts can contact the shielding from the inside.

In particular, the second shielding is formed as an angled metal sheet or as a plurality of angled metal sheets and is inserted from the side facing away from the plug side in the insulating housing.

The first shielding and/or the second shielding are preferably formed as stamped or punched out metal sheets.

The first shielding and/or the second shielding can have at least one fastening element stamped in or out of the metal sheet and/or fastening sections for fastening the shielding to the insulating body (that is, insulating housing) by introducing it into a corresponding recess formed in the insulating body. In particular, the fastening elements and/or sections could be pressed into or over pressed into recesses provided on the insulating body, so that a frictional connection is created.

The first shielding and/or the second shielding can have at least one spring tongue stamped in or out of the metal sheet for making contact with contacts of a corresponding plug within the plug-in region of the plug face of the insulating housing.

In particular, the second shielding is formed in one or more parts in the form of a plurality of segments to be arranged next to each other. The first and/or second shieldings can also be bent metal sheets that are arranged to create a bent shielded channel (that is, a channel having upper and lower shieldings). Only a few individual parts are thus needed, the production and assembly process being simplified.

The insulating housing or the insulating body can have a connecting element, for example, a connecting web, for stabilization when there are higher numbers of poles between the bottom of the plug face and the upper wall. The shielding sheets can still be used by being slotted from the front at the location of the connecting element, so that the connecting element extends through the slot in the assembled state. If the second shielding is segmented, the connecting element can be arranged between two segments lying next to each other.

A method according to the invention for producing an angled plug connector, in particular a plug connector as described above, comprises the steps:

a) punching out the shape of a first shielding and a second shielding from a metal sheet;

b) bending the stamped metal sheet of the first shielding and/or the second shielding to produce angled first and/or second shieldings; and c) at least partial sliding in or insertion of the shieldings into the interior of an insulating body from the side facing away from the plug side.

The first shielding is preferably in one piece as described above. The second shielding can also be in one piece or consist of a plurality of segments which are stamped separately and arranged next to each other in the insulating body.

The metal sheet is preferably uncoated. The process step of the coating is economized in this variant. The material is nevertheless resistant due to its properties.

In the first shielding and/or the second shielding, fastening sections for fastening to an insulating body can be produced by punching out of the metal sheet or stamping/cutting in the metal sheet.

In the first shielding and/or the second shielding, contact tongues for producing a contact with the contacts of a corresponding plug can be produced by punching out the metal sheet or punching/cutting in the metal sheet.

The shieldings can be positioned and fixed in the plug-in region by means of a simple crimped surface. The production of the crimped surface is a simple stamping process. The shielding is inserted and the fastening made in one step during placement, the process being simple and effective. Alternatively or additionally, fastening tabs can be provided in the connection region, the fastening tabs being aligned in the direction of placement or the insertion of the shieldings into the insulating housing. The fastening tabs can contribute to a secure and effective positioning and fastening in the connection region of the insulating housing.

As a result, the invention relates to a plug connector that can be easily produced and assembled with angled shielding channel or shielding cage, consisting of two or more shieldings that are stamped from a metal sheet, possibly cut, bent and inserted in the insulating housing from behind (with uniform insertion direction). At least first shielding sections of the bent shielding sheets are inserted into the plug-in region of the plug face of the insulating housing, so that a corresponding mating plug inserted into the plug face can contact the shielding sheets from the inside. Fastening sections and contact tongues are also easily produced by stamping. For example, the upper and/or the lower shielding sheet can be fixed by forwardly projecting crimped fastening sections, which are pushed or pressed into provided gaps or recesses of the insulating housing. This structure of the fastening sections or gaps can be repeated along the width.

All of the features that have been described or yet to be described, in the context of the application, as far as technically feasible, should be able to be combined in all possible variants.

BRIEF DESCRIPTION OF THE FIGURES

Further advantages, features and application options of the invention become apparent from the following representation of a preferred, but not limiting understood embodiment of the invention with reference to the drawings, wherein.

DETAILED DESCRIPTION OF A PREFERRED EMBODIMENT

Figure 1:
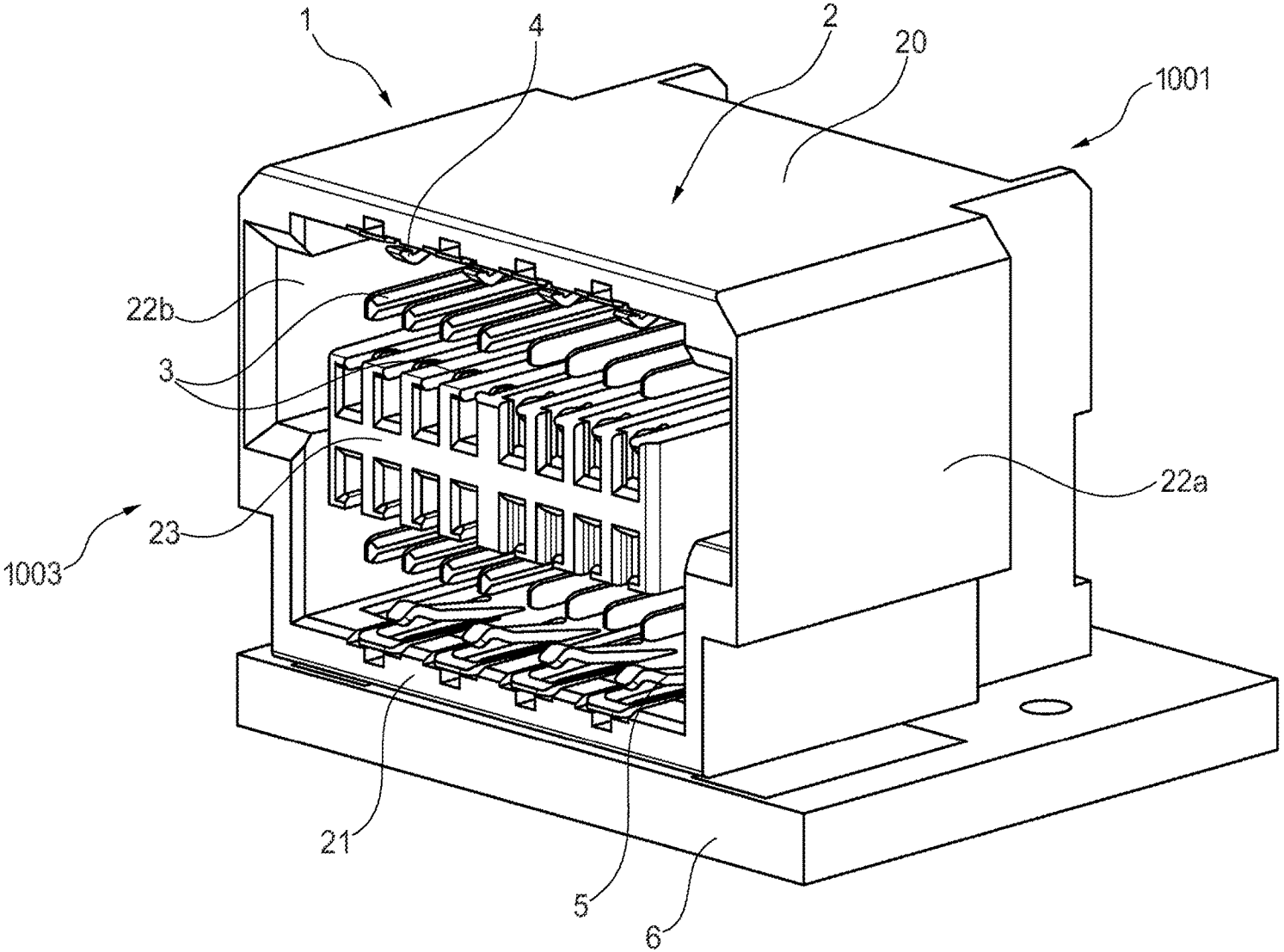
FIG. 1 shows a front perspective view of a plug connector according to the invention.

An angled plug connector 1 according to the invention is shown in FIG. 1. This is designed as a kind of adapter bushing/receiving housing for a corresponding plug (not shown).

The plug connector 1 has an insulating housing 2 made of plastic. The insulating housing comprises an upper wall 20, a lower wall 21, and side walls 22*a*, 22*b*. The upper wall 20 has a flat, planar outer side. This enables suction for handling the housing 2 during assembly. The walls delimit a receiving space for the corresponding plug. In addition, the insulating housing 2 has a block 23 which determines the plug face. The block 23 separates or insulates contact elements 3 of the plug connector 1 therein and plug-in contacts of the corresponding plug from each other therein. In this embodiment, the contact elements 3 of the plug connector 1 are formed as a contact blade or contact springs or combinations of the two. In addition, the plug connector 1 has a multi-part shielding, consisting of a first (upper) shielding sheet 4 and a second (lower) shielding 5. The shielding sheet 4 is formed as one piece or one part. The lower shielding 5 can be in one piece. However, it can preferably consist of two or more segments or shielding sheets arranged next to each other, as represented below in FIG. 2. The shieldings 4 and 5 are at least partially arranged in the interior of the insulating housing 2. The first shielding sheet 4 extends in sections along the inner side of the upper wall 20, the second shielding 5 along the inner side of the lower wall 21.

Figure 2:
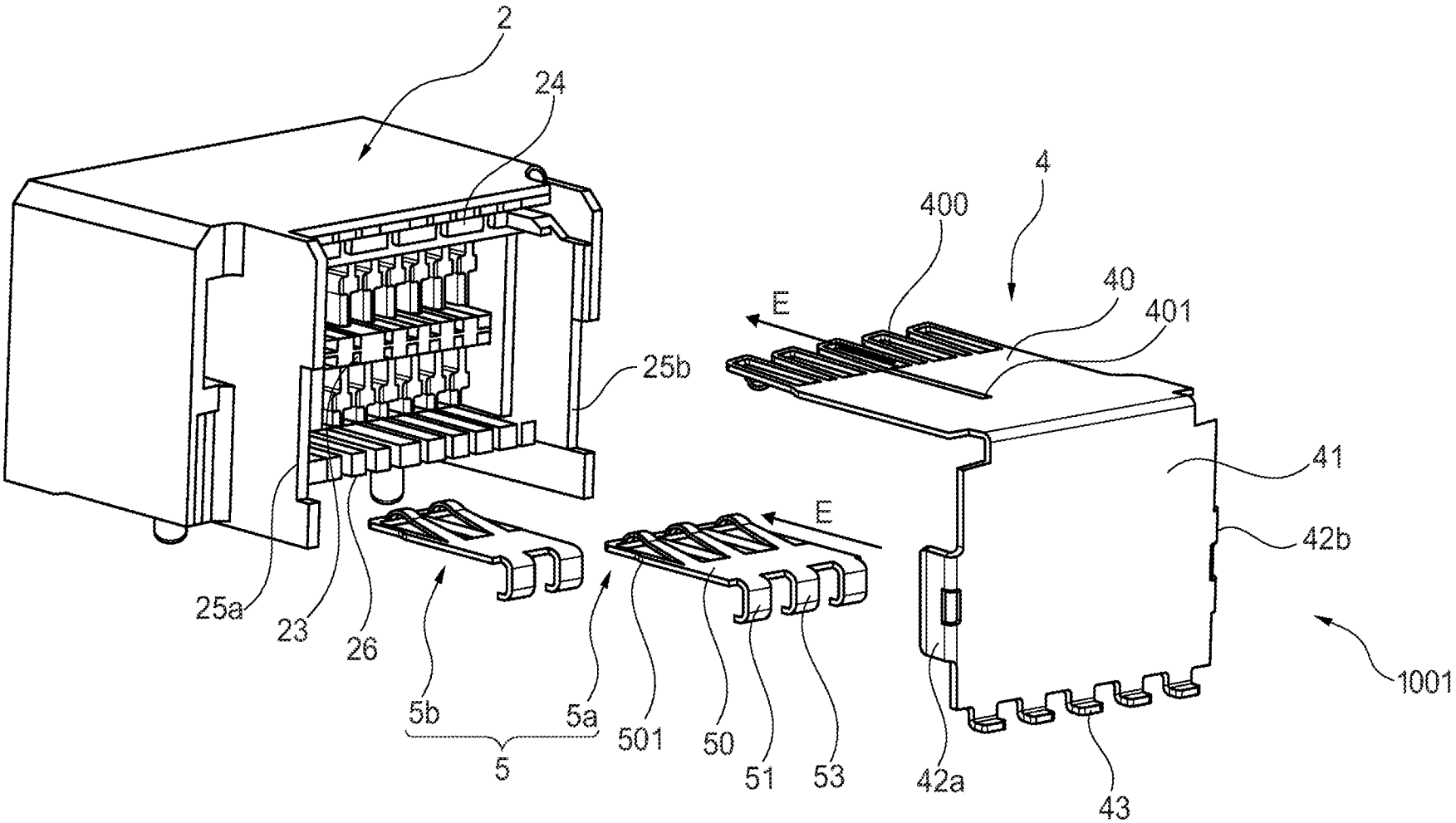
FIG. 2 shows a view of components of the plug connector of FIG. 1.

In FIG. 2, only the insulating housing 2 and the shieldings 4 and 5 are shown, in a separated state. The first shielding sheet 4 is designed as a stamped and bent component or metal sheet. The second shielding 5 consists of two stamped and bent components or metal sheets 5*a* and 5*b* arranged next to each other. The shieldings 4 and 5 can be easily stamped from a metal sheet, cut and then bent.

Figure 3:
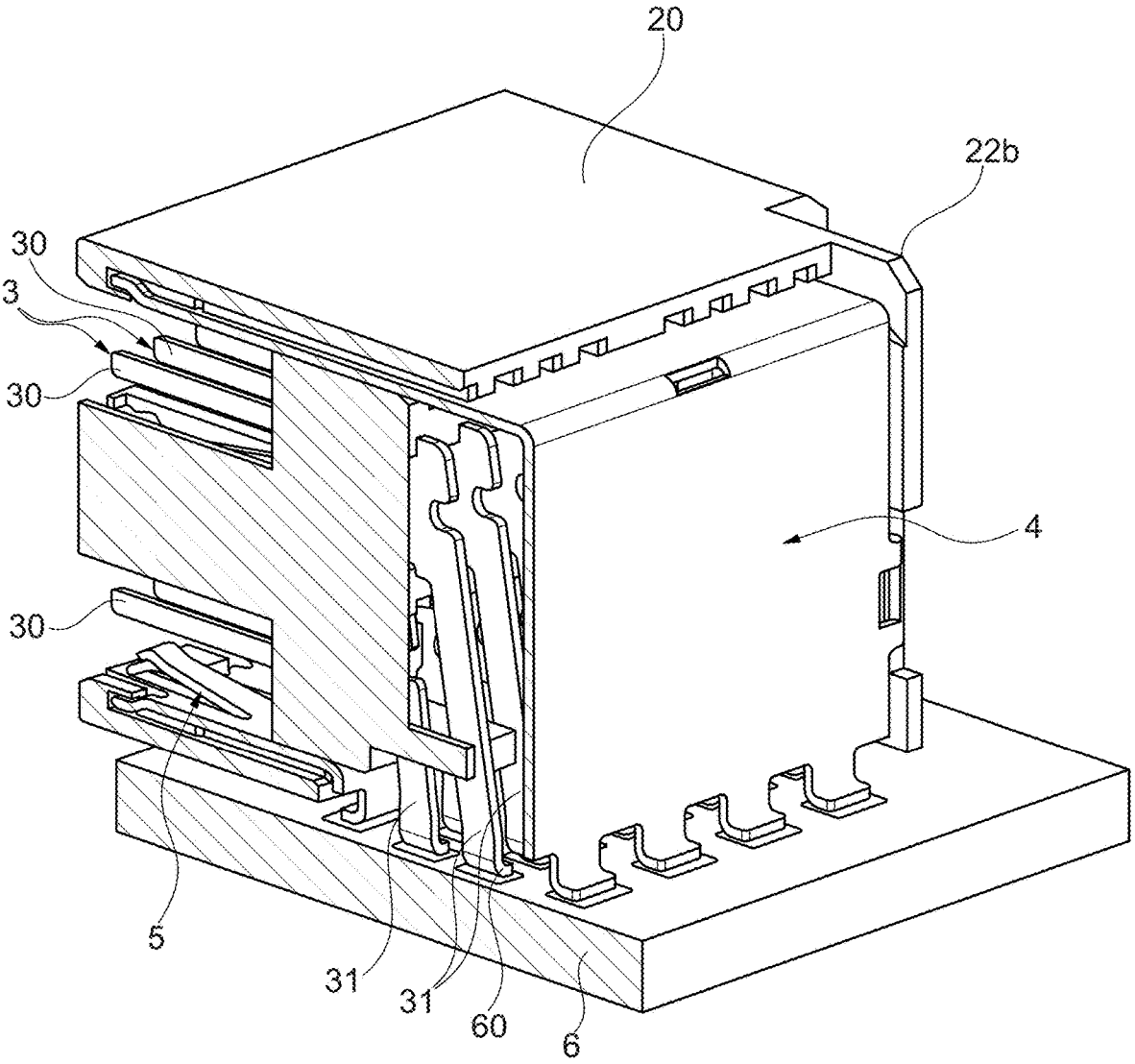
FIG. 3 shows a perspective sectional view of the plug connector of FIG. 1.

The first (upper) shielding sheet 4 has a first shielding section 40 and a second shielding section 41 angled at right angles thereto. The first shielding section 40 is inserted during assembly in the insertion direction E into a corresponding receptacle 24 in the insulating housing 2. The second shielding section 41 forms the rear side of the angled plug connector 1. Fastening tabs 42*a*, 42*b* extend forward on both sides from the second section 41. The fixing of the first shielding sheet 4 takes place by inserting the tabs 42*a*, 42*b* into corresponding recesses 25*a* and 25*b* of the insulating housing 2. The first shielding sheet 4 has contact feet 43 to create an electrical connection to ground contacts of a printed circuit board 6, as shown in FIG. 3. Spring tongues 400, which are produced by punching and crimping of the metal sheet, are formed in the first shielding sheet 4 to produce a secure electrical contact with corresponding contacts of a corresponding plug. If the insulating housing 2 has a vertical reinforcing wall (not represented) for stabilizing the housing 2, the first shielding sheet 4 can be guided by a slot 401 formed in the first shielding section 40.

Figure 4:
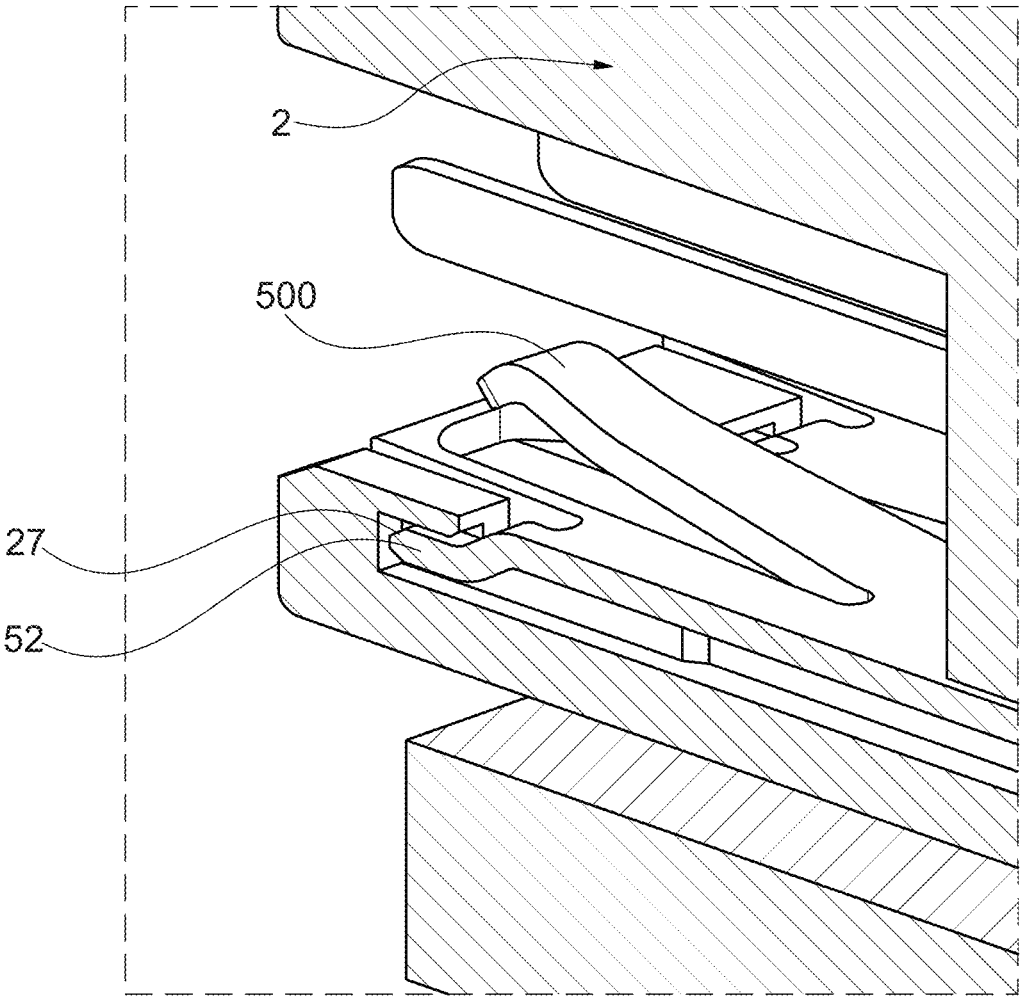
FIG. 4 shows a detail of FIG. 3.

The second (lower) shielding sheets 5*a* and 5*b* are constructed similarly to the first (upper) shielding sheet 4. The second shielding sheets 5*a* and 5*b* each have a first shielding section 50 and a second shielding section 51 angled at a right angle thereto (only indicated on the lower shielding sheet 5*a* by way of example). The latter section 51 is substantially shorter than the second shielding section 41 of the first shielding sheet 4 for geometrical reasons. Its height or length depends on the geometric conditions, namely substantially the distance of the first shielding section 50 from the contact points of the printed circuit board 6. If it makes sense for geometrical reasons, the second shielding section 51 can also be missing or have a height of zero. Then, contacts 53 extend at an angle directly from the first shielding section 50 toward the printed circuit board. The first shielding section 50 is inserted during assembly in the insertion direction E into a corresponding receptacle 26 in the insulating housing 2. One of the fastening sections 52 is represented in FIG. 4. The fastening sections 52 are formed as stamped and crimped tongues. During assembly, they are inserted and fixed in corresponding recesses 27 of the insulating housing 2. The second shielding 5 is thus fastened to the insulating housing 2. The fixation takes place in particular by overpressing, that is, the recesses 27 on the insulating housing are slightly narrower than the fastening section. The result is a frictional connection.

Spring tongues 500, which are produced by punching and crimping of the metal sheet, are formed in the second shielding 5 to produce a secure electrical contact with corresponding contacts of a corresponding plug. The structure can repeat along the front edge of the second shielding 5. The second shielding 5 has contact feet 53 for establishing an electrical connection to ground contacts of a printed circuit board 6, as represented in FIG. 3. If the insulating housing 2 has a vertical reinforcing wall (not represented) for stabilizing the housing 2, this can be guided by a slot 501 formed in the first shielding section 50.

The insertion during assembly takes place for all shielding sheets 4, 5*a* and 5*b* in a uniform insertion direction E from the back side 1001 or the connection side of the plug connector 1 (the back side 1001 is the side opposite a plug side 1003 comprising the plug face). The plug connector 1 in the assembled state is represented in FIG. 3 (parts of the insulating housing are omitted in the illustration). In particular, the design and arrangement of the contact elements 3 are shown. These have contacts 30, which are arranged in the plug face in rows next to each other or one above the other. In addition, the contact elements 3 have bent contact sections 31, the ends of which contact corresponding contacts 60 of a printed circuit board 6. The contacts 31, 60 are also arranged next to each other in rows and columns During assembly, the second shielding sheets 5*a*, 5*b*, the contact elements 3 and the first shielding sheet 4 are inserted from the back side into the insulating housing 2 in the sequence.

Figure 5:
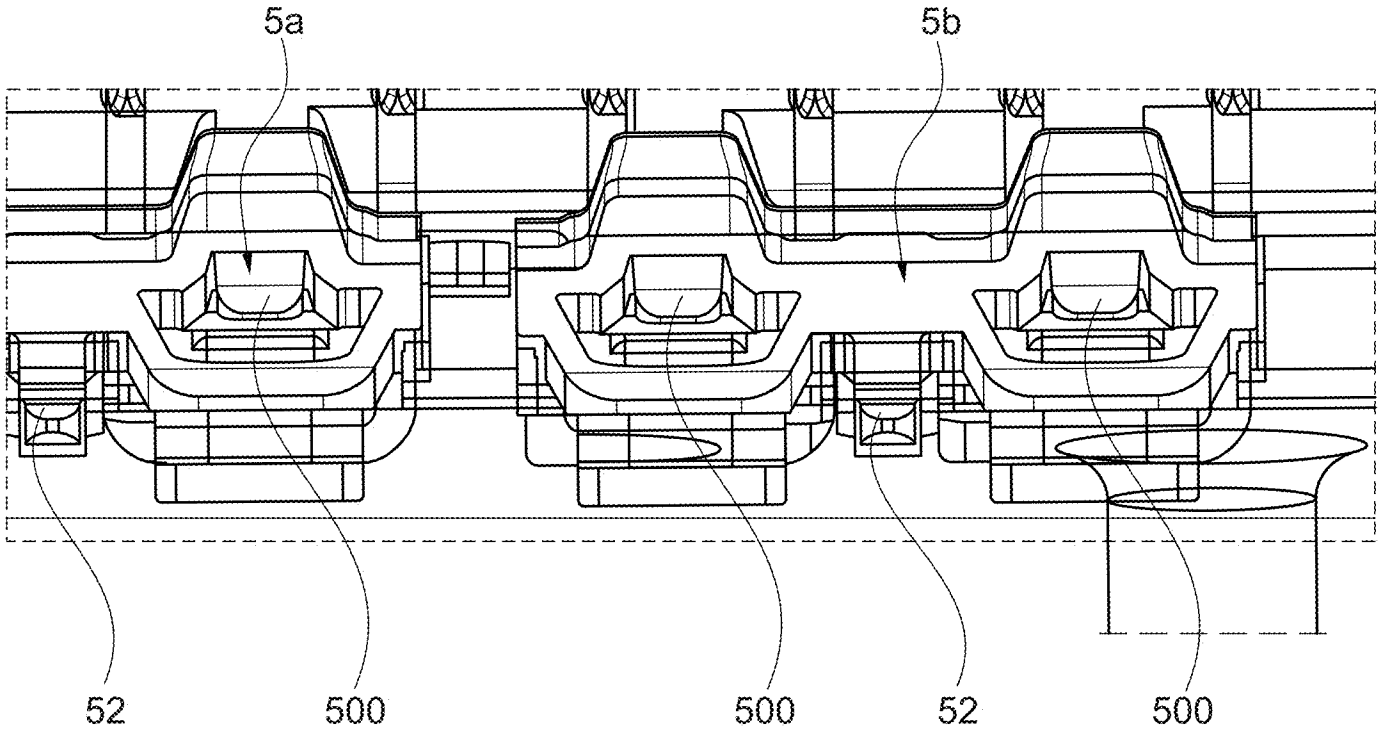
FIG. 5 shows a further detail of the plug connector according to the invention.

FIGS. 4 and 5 show details, in particular of the second shielding 5, comprising fastening sections 52 which are arranged between contact tongues 500. While the fastening sections 52 protrude into recesses 27 of the housing 2, the contact tongues 500 are bent upwardly to establish good contact with corresponding mating contacts of a corresponding plug. It is clear from FIG. 5 how the contact tongues 500 are produced by punching and bending of the metal sheet.

The fastening and fixation of the upper shielding sheet 4 can be done in the same way. The structure of the front edge of the upper shielding sheet 4 therefore substantially corresponds to the structure of the front edge of the lower shielding 5.

Both manufacturing and assembly of the plug connector 1 are simple, since parts of the shielding 4, 5 are merely stamped, bent and inserted into the insulating housing 2.

The invention claimed is:

1. An angled plug connector, comprising:

an insulating housing having a plug side and a back side facing opposite said plug side;

angled contact elements for establishing a connection between a corresponding plug and a printed circuit board;

a first shielding; and a second shielding, the first and second shieldings together forming a shielded channel, wherein the first shielding is formed as an angled metal sheet and in one part or in one piece, wherein the first shielding is inserted into the insulating housing from the back side facing away from the plug side, and wherein at least one of the first shielding and the second shielding has at least one spring tongue stamped in or out of the metal sheet for contacting with contacts of the corresponding plug within a plug-in region at the plug side of the insulating housing.

2. The angled plug connector according to claim 1, wherein the second shielding is formed as one or more angled metal sheets, which are inserted from the back side facing away from the plug side into the insulating housing.

3. The angled plug connector according to claim 2, wherein the second shielding is formed as one part or as two or more segments arranged next to each other.

4. The angled plug connector according to claim 1, wherein at least one of the first shielding and the second shielding are formed as stamped metal sheets.

5. The angled plug connector according to claim 1, wherein at least one of the first shielding and the second shielding has at least one fastening element stamped in or out of the metal sheet and/or a fastening section for fastening the at least one of the first shielding and the second shielding on to the insulating housing by introduction into a corresponding recess formed in the insulating housing.

6. The angled plug connector according to claim 1, wherein at least one of the first shielding and the second shielding is arranged in the plug-in region of the plug face such that a mating plug provided with external contacts can contact the shielding from inside an interior of the insulating housing.

7. A method for producing the angled plug connector according to claim 1, comprising:

a) punching out a first shielding and a second shielding from a metal sheet;

b) bending at least one of the first shielding and the second shielding to produce angled first and second shieldings; and c) at least partially inserting the at least one of the first shielding and the second shielding into an interior of an insulating housing from a back side of the insulating housing facing away from a plug side of the insulating housing, wherein contact tongues, of at least one of the first shielding and the second shielding, for establishing contact with contacts of a corresponding plug within a region at the plug side of the insulating housing, are produced by punching out of the metal sheet or stamping in the metal sheet.

8. The method according to claim 7, wherein the first shielding is formed as one part.

9. The method according to claim 7, wherein the metal sheet is uncoated.

10. The method according to claim 7, wherein fastening sections, of at least one of the first shielding and the second shielding, for fastening to the insulating housing, are produced by punching out of the metal sheet or stamping in the metal sheet.

11. The method according to claim 8, wherein fastening sections, of at least one of the first shielding and the second shielding, for fastening to the insulating housing, are produced by punching out of the metal sheet or stamping in the metal sheet.

12. The method according to claim 9, wherein fastening sections, of at least one of the first shielding and the second shielding, for fastening to the insulating housing, are produced by punching out of the metal sheet or stamping in the metal sheet.

* * * * *